US010679816B1

(12) United States Patent
Moody et al.

(10) Patent No.: US 10,679,816 B1
(45) Date of Patent: Jun. 9, 2020

(54) THERMIONIC CATHODE WITH A GRAPHENE SEALING LAYER AND METHOD OF MAKING THE SAME

(71) Applicant: Los Alamos National Security, LLC, Los Alamos, NM (US)

(72) Inventors: Nathan Moody, Los Alamos, NM (US); Gautam Gupta, Los Alamos, NM (US); Aditya Mohite, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 0 days.

(21) Appl. No.: 15/644,704

(22) Filed: Jul. 7, 2017

Related U.S. Application Data

(60) Provisional application No. 62/360,288, filed on Jul. 8, 2016.

(51) Int. Cl.
*H01J 1/142* (2006.01)
*H01J 9/04* (2006.01)

(52) U.S. Cl.
CPC ..... *H01J 1/142* (2013.01); *H01J 9/042* (2013.01); *H01J 2201/02* (2013.01)

(58) Field of Classification Search
None
See application file for complete search history.

(56) References Cited

U.S. PATENT DOCUMENTS

| | | | | |
|---|---|---|---|---|
| 4,528,474 | A * | 7/1985 | Kim | H01J 1/15 313/300 |
| 6,791,251 | B2 | 9/2004 | Seo et al. | |
| 6,800,990 | B2 | 10/2004 | Choi et al. | |
| 8,823,259 | B2 | 9/2014 | Moody | |
| 8,957,573 | B2 | 2/2015 | Vancil | |
| 8,981,338 | B2 | 3/2015 | Fuke et al. | |
| 9,102,524 | B2 | 8/2015 | Papadakis | |
| 9,790,620 | B1 * | 10/2017 | Katsap | C30B 29/66 |
| 2003/0001477 | A1 * | 1/2003 | Sasaguri | H01J 3/022 313/310 |
| 2004/0061429 | A1 * | 4/2004 | Sakai | B82Y 10/00 313/491 |
| 2005/0067602 | A1 * | 3/2005 | Schutz | B67D 3/04 251/305 |
| 2005/0174030 | A1 * | 8/2005 | Katsap | H01J 1/148 313/346 R |
| 2005/0212395 | A1 * | 9/2005 | Anazawa | B82Y 10/00 313/311 |
| 2009/0291270 | A1 | 11/2009 | Zettl et al. | |

(Continued)

OTHER PUBLICATIONS

U.S. Notice of Allowance dated Oct. 3, 2018, for cross reference U.S. Appl. No. 15/644,711, (8 pages).

*Primary Examiner* — Ashok Patel
(74) *Attorney, Agent, or Firm* — Lewis Roca Rothgerber Christie LLP

(57) ABSTRACT

According to an embodiment of the present disclosure, a thermionic cathode includes: a cathode body having an outer surface, and a sealing layer including one or more graphene sheets on the outer surface of the cathode body. According to another embodiment of the present disclosure, a method for manufacturing a thermionic cathode includes: depositing a sealing layer including one or more graphene sheets on an outer surface of a cathode body.

9 Claims, 4 Drawing Sheets

(56) References Cited

U.S. PATENT DOCUMENTS

| | | | | |
|---|---|---|---|---|
| 2011/0048625 | A1 | 3/2011 | Caldwell et al. | |
| 2012/0244281 | A1* | 9/2012 | Fox | C23C 14/024 427/250 |
| 2012/0295096 | A1 | 11/2012 | Liu et al. | |
| 2014/0097736 | A1* | 4/2014 | Katsap | H01J 1/14 313/37 |
| 2014/0139100 | A1* | 5/2014 | Kobayashi | H01J 1/148 313/346 R |
| 2015/0206694 | A1* | 7/2015 | Liu | H01J 29/04 257/10 |
| 2015/0247178 | A1 | 9/2015 | Mountcastle et al. | |
| 2016/0074815 | A1 | 3/2016 | Sinton et al. | |

* cited by examiner

THERMIONIC CATHODE WITH A GRAPHENE SEALING LAYER AND METHOD OF MAKING THE SAME

CROSS-REFERENCE TO RELATED PATENT APPLICATION

This application claims priority to and the benefit of U.S. Provisional Patent Application No. 62/360,288, filed in the United States Patent and Trademark Office on Jul. 8, 2016, the entire content of which is incorporated herein by reference.

STATEMENT REGARDING FEDERAL RIGHTS

The United States government has rights in this invention pursuant to Contract No. DE-AC52-06NA25396 between the United States Department of Energy and Los Alamos National Security, LLC for the operation of Los Alamos National Laboratory.

FIELD OF THE INVENTION

The present invention generally relates to thermionic cathodes.

BACKGROUND

Thermionic cathodes (also referred to as hot cathodes) are cathode electrodes which emit electrons when heated, due to thermionic emission. They are a standard component in many vacuum electronic devices, including those requiring high reliability and a proven legacy, as many customers and targeted applications are attracted to thermionic technology due to the decades of testing these devices have undergone. For example, thermionic cathodes may be used in high power microwave devices, compact electron accelerators, amplifier tubes, klystrons, and medical x-ray imaging machines. The temperature for thermionic emission may be as high as about 1000° C. or greater.

In order to improve thermionic emission efficiency, a finite amount of barium oxide (BaO) is added to the thermionic cathode to activate the thermionic cathode. BaO has been demonstrated to improve the probability of emission when heated to a high temperature (e.g., about 1000° C.). However, at high temperature, BaO is also driven off into the vacuum space enclosing the thermionic cathode. As such, BaO may be lost to the vacuum space and therefore the effect it has on the probability of emission is also diminished.

SUMMARY

According to an embodiment of the present disclosure, a thermionic cathode includes: a cathode body having an outer surface, and a sealing layer including one or more graphene sheets on the outer surface of the cathode body.

The sealing layer may further include a dopant doped in the one or more graphene sheets.

The dopant may be intercalated into cells of honey comb shaped crystal lattices of the graphene sheet.

The cathode body may include a cathode material and an additive. The additive may include a metal oxide. The dopant may include a metal element. The metal element in the dopant and a metal element in the metal oxide of the additive may be the same.

The dopant may be doped at less than or equal to a saturated amount.

The dopant may include barium (Ba).

The sealing layer may completely cover the outer surface of the cathode body. The sealing layer may include 1 to 20 graphene sheets.

According to another embodiment of the present disclosure, a method for manufacturing a thermionic cathode includes: depositing a sealing layer including one or more graphene sheets on an outer surface of a cathode body.

The depositing of the sealing layer may include depositing the sealing layer directly onto the outer surface of the cathode body utilizing chemical-vapor-deposition.

The cathode body may have a planar shape, a cylindrical shape, a helical shape or an irregular shape.

The depositing of the sealing layer may include co-depositing a dopant and carbon on the outer surface of the cathode body to form a doped graphene sheet. The dopant may be intercalated into cells of honey comb shaped crystal lattices of the doped graphene sheet.

The depositing of the sealing layer may include: depositing a graphene layer on a carrier substrate to form a graphene layer-carrier laminate; applying a polymer film on the graphene layer to form a polymer film-graphene layer-carrier laminate; removing the carrier substrate from the polymer film-graphene layer-carrier laminate to form a polymer film-graphene layer laminate; attaching the polymer film-graphene layer laminate on the outer surface of the cathode body; and removing the polymer film from the polymer film-graphene layer laminate.

The method may further include removing a native oxide layer from the carrier substrate prior to the depositing of the graphene layer.

The substrate may be a Cu foil or a Ni foil.

The depositing of the graphene layer may include a chemical-vapor-deposition process.

DETAILED DESCRIPTION

Figure 1B:
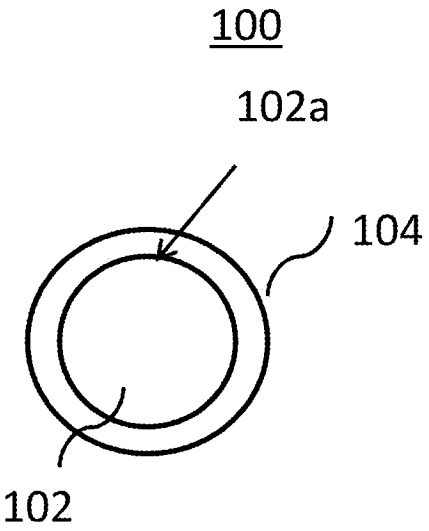
FIG. 1B is a schematic cross sectional view of a thermionic cathode according to an embodiment of the present disclosure.

Reference will now be made in more detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments of the present disclosure are merely described below, by referring to the figures, to explain aspects of the present description.

As used herein, the term "and/or" includes any and all combinations of one or more of the associated listed items. Expressions such as "at least one of," when preceding a list of elements, modify the entire list of elements and do not modify the individual elements of the list.

As the inventive concept allows for various changes and numerous embodiments, particular embodiments will be illustrated in the drawings and described in more detail in the written description. Effects, features, and a method of achieving the inventive concept will be obvious by referring to exemplary embodiments of the inventive concept with reference to the accompanying drawings. The inventive concept may, however, be embodied in many different forms and should not be construed as being limited to the embodiments set forth herein.

In the embodiments described in the present specification, an expression utilized in the singular encompasses the expression of the plural, unless it has a clearly different meaning in the context. Also, it is to be understood that the terms such as "including," "having," and/or "comprising" are intended to indicate the presence of the stated features or components, and are not intended to preclude the presence or addition of one or more other features or components.

It will be understood that when a layer, region, or component is referred to as being "on" or "onto" another layer, region, or component, it may be directly or indirectly formed on the other layer, region, or component. That is, for example, intervening layer(s), region(s), or component(s) may be present.

Sizes of components in the drawings may be exaggerated for convenience of explanation. In other words, since sizes and thicknesses of components in the drawings are arbitrarily illustrated for convenience of explanation, the following embodiments of the present disclosure are not limited thereto.

Figure 1A:
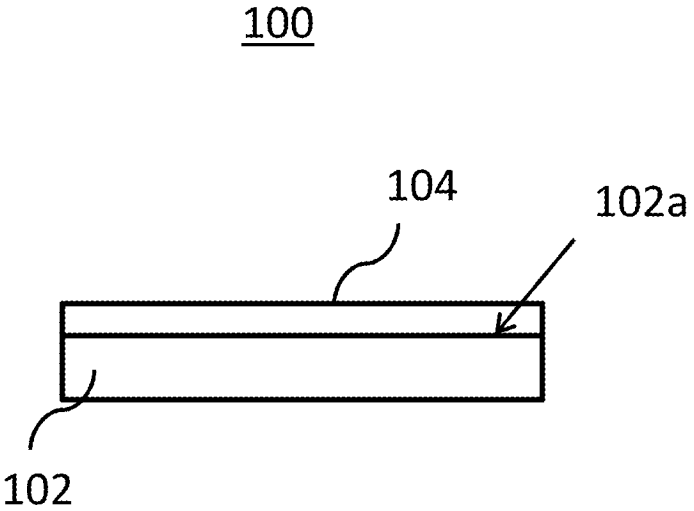
FIG. 1A is a schematic cross sectional view of a thermionic cathode according to an embodiment of the present disclosure.

FIGS. 1A and 1B are each a schematic cross sectional view of a thermionic cathode according to an embodiment of the present disclosure. Referring to FIGS. 1A and 1B, a thermionic cathode 100 includes: a cathode body 102 having an outer surface 102*a*, and a sealing layer 104 including one or more graphene sheets on the outer surface of the cathode body.

The cathode body 102 may include a cathode material and an additive. The cathode material can be any suitable material, such as tungsten (W), or nickel (Ni). The additive may be any suitable material that may improve the emission efficiency of the cathode material. In one embodiment, the additive is a low work function material, such as a compound of metals (for example, a metal oxide) with a low work function. For example, the additive may be barium oxide (BaO), strontium oxide (SrO), calcium oxide (CaO), aluminum oxide ($Al_2O_3$), thorium oxide (ThO), or a mixture thereof. In one embodiment, the additive is BaO. The additive may be mixed with the cathode material, or may be coated on the cathode material.

The sealing layer 104 may be formed on an outer surface of the cathode body 102. The sealing layer includes one or more graphene sheets. Graphene is generally described as a one-atom-thick planar sheet of sp2-bonded carbon atoms that are densely packed in a honeycomb shaped crystal lattice. Graphene is the basic structural element of some carbon allotropes including graphite, carbon nanotubes and fullerenes. It should be understood that the terms "graphene," and "graphene sheet" as used herein refer only to a single layer or a single sheet of graphene, while the term "graphene layer" may refer to a single sheet of graphene or multiple graphene sheets stacked over one another.

Graphene has many desired (e.g., outstanding) properties which make it suitable for the sealing layer: ultra-high electrical and thermal conductivity, optical transparency, impermeability to molecular gases, high charge mobility, and ability to sustain extreme current densities.

The sealing layer may include 1 to 20 layers of graphene sheets. For example, the graphene layer may include a single layer of graphene sheet. In another embodiment, the graphene layer may include 2-5 layers of graphene sheets. When the number of graphene sheets is within the ranges described above, the graphene layer provides suitable protection to the thermionic cathode, and the thermionic cathode may have a higher emission efficiency for a longer period of time, even at a high temperature (i.e., at about 1000° C. or greater).

Figure 2:
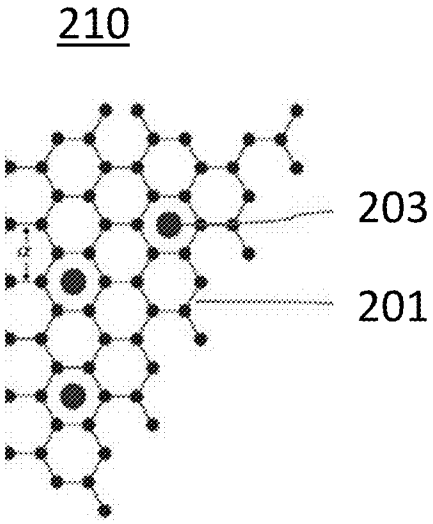
FIG. 2 is a schematic illustration of a graphene layer intercalated with a dopant element.

The sealing layer 104 may further include a dopant doped in the one or more graphene sheets. The dopant may include a metal element similar to or the same as the metal in the cathode body (e.g., the metal in the metal oxide additive). For example, the dopant may be alkali elements (alkali metal elements or alkali earth metal elements), such as barium (Ba). The dopant metal element may be intercalated in the cells of the honeycomb shaped crystal lattices of graphene sheet. FIG. 2 is a schematic illustration of a graphene layer intercalated with a dopant element. The graphene layer 210 includes cells 201 forming honeycomb shaped crystal lattices. The dopant 203 is intercalated inside the cells 201. The dopant may be doped at a positive amount up to a saturated amount. That is, the dopant may be doped up to an amount where all the cells of the honeycomb shaped crystal lattices of graphene sheet are intercalated with the alkali elements such as Ba atoms.

The sealing layer may completely cover the outer surface of the cathode body. In one embodiment, the cathode body has a planar shape and is sandwiched between the sealing layer and a carrier substrate, where the sealing layer is in direct contact with the carrier substrate at the peripheral edges surrounding the cathode body to completely enclose the cathode body. In another embodiment, the cathode body has a curved shaped such as a cylinder or a helix, and the sealing layer completely covers the outer surface of the cathode body.

Conventional thermionic cathodes including a cathode material mixed with the additive (i.e., the lower work function material) utilize a so-called "dispenser" action wherein the additive is "dispensed" from within the bulk of the cathode body during high temperature operation and transported to the surface. The lifetime of the cathode is defined as the operational period required for depletion of the low work function material. Currently, lifetimes are undesirably low due to the high temperatures involved in thermionic emission (1000° C. or greater).

The thermionic cathode according to one or more embodiments of the present disclosure has the following desired features. First, by having a graphene layer sealing the cathode body, it passivates the outer surface of the cathode body. The graphene layer isolates the high temperature cathode body surface from potentially chemically reactive gas species surrounding the cathode body that may cause corruption of the low work function surface (the surface of the cathode body where the additive with a low work function is mixed with the cathode material).

Second, the graphene sealing layer provides a mechanism for confining the "dispensing" material (i.e., the additive) whose low work function enables electronic emission. This is accomplished by countering the high temperature desorption and evaporation of the additive with the placement of a thin hermetic barrier (i.e., the graphene layer) on the surface. Therefore, the low work function material diffuses to the surface of the cathode body as desired, but does not immediately desorb directly into the vacuum space. This function enables much longer lifetime of the cathode.

Further, the graphene sealing layer acts as a concentrator of the dispensed low work function material, which may provide significant performance gains.

In addition, embodiments of the present disclosure also provide a solution of doping the graphene sealing layer (i.e., the surface of the cathode) with specific atomic species which may modify (manipulate) the cathode characteristics in a predictable manner. This is typically not possible in conventional thermionic cathodes because the very high temperature of the surface causes any potential dopant to rapidly evaporate (leave the cathode surface). According to an embodiment of the present disclosure, graphene is functionalized to accept a certain concentration (e.g., a certain number) of dopants which then become chemically stable and part of the surface of the cathode.

According to another embodiment of the present disclosure, a method for manufacturing a thermionic cathode includes: depositing a sealing layer including one or more graphene sheets on an outer surface of a cathode body.

The depositing of the sealing layer may include depositing the sealing layer directly onto the surface of the cathode body utilizing a suitable method, such as chemical-vapor-deposition (CVD). For example, the cathode body may be loaded in a chemical vapor deposition apparatus suitable for depositing graphene layers, such as a commercially available diamond growth chamber (e.g., Kurt J. Lester or equivalent) or a custom-designed vacuum system with similar capabilities. A graphene layer may then be deposited on the cathode body.

High temperatures are required for graphene growth and the temperature is typically at 900° C. or higher. The conditions for depositing the graphene layer may be any suitable condition. For example, the graphene layer may be formed in a CVD process conducted at 1000° C. utilizing $CH_4/H_2$. However, embodiments of the present disclosure are not limited thereto.

In one embodiment, after the loading of the cathode body, $CH_4/H_2$ is provided in the CVD chamber at a set or predetermined flow rate. For example, $CH_4$ may be supplied at 20 standard cubic centimeters per minute (sccm) and $H_2$ may be supplied at 10 sccm. The temperature of the CVD chamber is about 1000° C. to thereby deposit a graphene layer directly on the outer surface of the cathode body. In forming a graphene layer directly on the cathode body, the shape of the cathode body is not particularly limited and may be in any suitable shape desired for the cathode body, such as cylindrical, helical, or irregular.

The depositing of the sealing layer may include co-depositing a dopant and carbon on the outer surface of the cathode body to form a doped graphene sheet. The dopant may be any suitable material. For example, the dopant may include a metal element such as barium (Ba). The dopant metal element may be intercalated in the cells of the honeycomb shaped crystal lattices of graphene sheet. The dopant may be doped at a positive amount up to a saturated amount. That is, the dopant may be doped up to an amount where all cells of the honeycomb shaped crystal lattices of the graphene sheet are intercalated with Ba atoms.

According to another embodiment of the present disclosure, the depositing of the sealing layer may include: depositing a graphene layer on a carrier substrate to form a graphene layer-carrier laminate; applying a polymer film on the graphene layer to form a polymer film-graphene layer-carrier laminate; removing the carrier substrate from the polymer film-graphene layer-carrier laminate to form a polymer film-graphene layer laminate; attaching the polymer film-graphene layer laminate on the outer surface of the cathode body; and removing the polymer film from the polymer film-graphene layer laminate.

Figure 3:
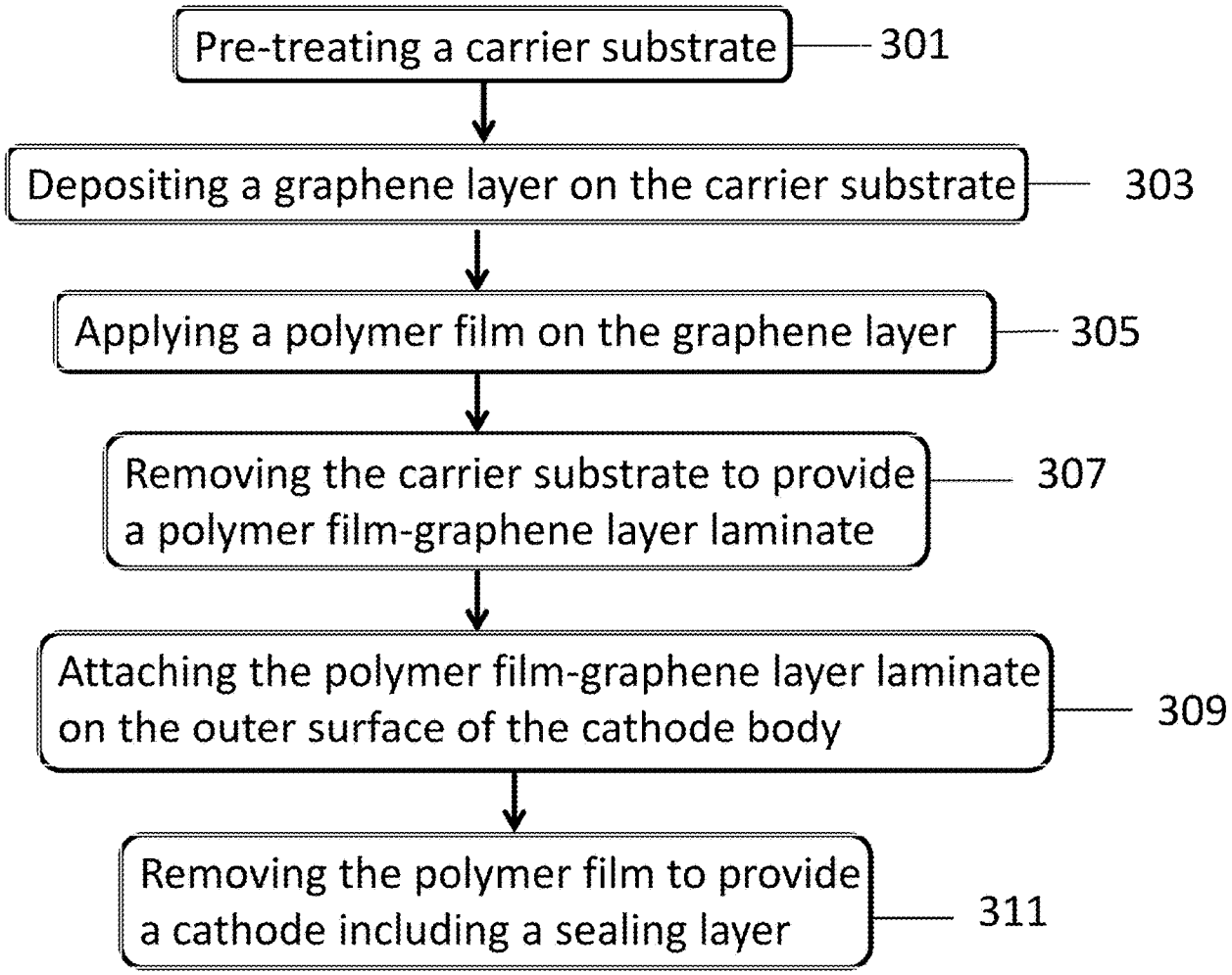
FIG. 3 is a flow chart illustrating a process of depositing a graphene layer on a substrate.

FIG. 3 is a flow chart illustrating a process of depositing a graphene layer on a substrate. Referring to FIG. 3, at act 301, a carrier substrate is first pre-treated. At act 303, a graphene layer is deposited on the carrier substrate. At act 305, a polymer film is applied on the graphene layer to form a polymer film-graphene layer-carrier laminate. At act 307, the carrier substrate is removed from the polymer film-graphene layer-carrier laminate to form a polymer film-graphene layer laminate. At act 309, the polymer film-graphene layer laminate is attached on the outer surface of the cathode body. At act 311, the polymer film is removed from the polymer film-graphene layer laminate and a cathode including a sealing layer on an outer surface of the cathode body is manufactured.

The carrier substrate may be any suitable material that can stand the graphene layer deposition process and do not chemically interfere with the graphene layer. For example, the carrier substrate may be Cu foil or Ni foil. The carrier substrate may be pre-treated with an annealing process prior to the deposition of the graphene layer. For example, the carrier substrate may be heated at 400° C. for at least two hours in at least 1E-8 Torr vacuum.

The depositing of the graphene layer may be through chemical-vapor-deposition (CVD) as disclosed above with respect to the deposition of the graphene layer directly on the cathode body. However, embodiments of the present disclosure are not limited thereto.

Figures 4A, 4B, 4C, 4D:
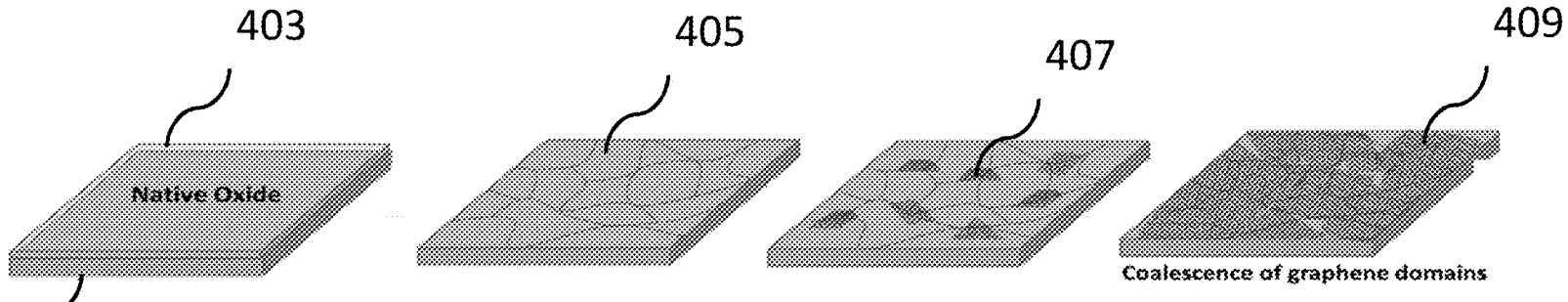
FIGS. 4A to 4D are schematic illustrations of a process of depositing a graphene layer on a substrate.

FIGS. 4A to 4D are schematic illustrations of a process of depositing a graphene layer on a substrate. Referring to FIG. 4A, a carrier substrate 401 is provided. The carrier substrate 401 may include a native oxide layer 403 on a surface thereof. After an annealing process has been conducted, as shown in FIG. 4B, the native oxide 403 is removed from the carrier substrate 401 and a clean surface 405 of the carrier substrate is exposed. After the substrate is loaded into a CVD chamber and $CH_4/H_2$ is provided in the CVD chamber at a set or predetermined flow rate, isolated graphene domains 407 are deposited on the substrate, as shown in FIG. 4C. The CVD chamber is maintained at about 1000° C. The graphene domains then grow and coalescence into the graphene layer 409 (e.g., a single layer of graphene) as shown in FIG. 4D.

The polymer film may be applied on the graphene layer-carrier laminate through any suitable method, such as spin coating. The polymer film may be made of a suitable material, such as PMMA.

The removing of the carrier substrate from the polymer film-graphene layer-carrier laminate may include: etching away the carrier substrate, or peeling the carrier substrate away utilizing a mechanical force. The etching may be conducted utilizing a suitable etchant, for example, an acid including a blend of $HNO_3$, $H_3PO_4$ and $H_2O$, and the etching may be conducted for about 2 to 6 hours. In one embodiment, the polymer film-graphene layer laminate may be transferred to the target substrate, or an intermediate substrate, such as a $Si/SiO_2$ substrate, to be followed by drying of the polymer film-graphene layer laminate.

In another embodiment, the carrier substrate may be removed through a mechanical force. For example, the carrier substrate may be peeled off from the polymer film-graphene layer-carrier laminate by a mechanical force.

The attaching of the polymer film-graphene layer laminate to the ourter surface of the cathode body may be simply realized by bringing the free surface of the graphene layer (i.e., the side opposite to the one in contact with the polymer film) in contact with the outer surface of the cathode body. It is believed that the van der Waals force forms a strong bond between the graphene layer and the cathode body, and between adjacent graphene sheets when a plurality of graphene sheets are individually formed and stacked together afterwards. However, embodiments of the present disclosure are not limited thereto.

The removing of the polymer film from the polymer film-graphene layer laminate may include etching the polymer film utilizing a suitable solvent, such as acetone. The surface of the graphene layer from which the polymer layer is removed may be treated using a thermal cleaning procedure. A graphene sealed thermionic cathode is thereby manufactured.

Additional graphene sheets may be deposited on the carrier substrate and transferred to the graphene side of the graphene sealed thermionic cathode to provide a graphene layer with multiple graphene sheets. Alternatively, multiple graphene sheets may be deposited on the carrier substrate first, and then laminated with the cathode body.

The size of the graphene layer may be larger than that of the cathode body to completely cover the outer surface of the cathode body.

A graphene sealed cathode according to embodiments of the present disclosure may have extended lifetime due to the monolayer or multiple layers of graphene, which provide a passivating surface layer to the cathode body. This surface monolayer or multiple layers of graphene act to prevent loss of the additive, which has low work function and provides photo-activating function. Without the graphene layer, the additive would desorb from the surface due to high temperature. The graphene sealing layer allows concentrating of the additive at the surface of the cathode body and extending of the lifetime of an otherwise untreated cathode. Furthermore, doping the graphene layer (intentional introduction of interstitial atoms in the graphene film) using compounds similar or identical to the additive being dispensed may further improve the emission efficiency and lifetime of the thermionic cathode.

The foregoing description of the preferred embodiments of the invention has been presented for purposes of illustration and description and is not intended to be exhaustive or to limit the claimed invention to the precise form disclosed. Those of skill in the art will readily appreciate that many modifications and variations to the claimed invention are possible in light of the above teaching. The embodiments were chosen and described in order to best explain the principles of the invention and its practical application to thereby enable others skilled in the art to best utilize the invention in various photocathode embodiments and with various modifications as are suited to the particular use contemplated. It is intended that the scope of the invention be defined exclusively by the following claims, and equivalents thereof.

We claim:

1. A method for manufacturing a thermionic cathode, the method comprising:

providing a cathode body, the cathode body having an outer surface, and depositing a sealing layer comprising 1 to 20 graphene sheets on the outer surface of the cathode body, wherein the graphene sheets conform to the outer surface of the cathode body.

2. The method of claim 1, wherein the depositing of the sealing layer comprises depositing the sealing layer directly onto the outer surface of the cathode body utilizing chemical-vapor-deposition.

3. The method of claim 2, wherein the cathode body has a planar shape, a cylindrical shape, a helical shape or an irregular shape.

4. The method of claim 1, wherein the depositing of the sealing layer comprises:

co-depositing a dopant and carbon on the outer surface of the cathode body to form a doped graphene sheet.

5. The method of claim 4, wherein the dopant is intercalated into cells of honey comb shaped crystal lattices of the doped graphene sheet.

6. A method for manufacturing a thermionic cathode, the method comprising:

depositing a sealing layer comprising 1 to 20 graphene sheets on an outer surface of a cathode body, wherein the depositing of the sealing layer comprises:

depositing a graphene layer on a carrier substrate to form a graphene layer-carrier laminate, applying a polymer film on the graphene layer to form a polymer film-graphene layer-carrier laminate, removing the carrier substrate from the polymer film-graphene layer-carrier laminate to form a polymer film-graphene layer laminate, attaching the polymer film-graphene layer laminate on the outer surface of the cathode body, and removing the polymer film from the polymer film-graphene layer laminate, and wherein the thermionic cathode comprises the sealing layer and the cathode body.

7. The method of claim 6, further comprising removing a native oxide layer from the carrier substrate prior to the depositing of the graphene layer.

8. The method of claim 6, wherein the carrier substrate is a Cu foil or a Ni foil.

9. The method of claim 6, wherein the depositing of the graphene layer comprises a chemical-vapor-deposition process.

* * * * *